US005237838A

United States Patent [19]

Merritt-Munson

[11] Patent Number: 5,237,838

[45] Date of Patent: Aug. 24, 1993

[54] PORTABLE REFRIGERATED COSMETIC CARRYING BAG

[76] Inventor: Carolann Merritt-Munson, 4820 Coldwater Canyon, #101, Sherman Oaks, Calif. 91403

[21] Appl. No.: 886,872

[22] Filed: May 22, 1992

[51] Int. Cl.[5] ..... B65D 23/08

[52] U.S. Cl. ..... 62/457.2; 62/530; 220/418

[58] Field of Search ..... 62/457.1, 457.2, 457.4, 62/457.5, 371, 372, 529, 530; 220/418

[56] References Cited

U.S. PATENT DOCUMENTS 2,563,933 8/1951 Hipps et al. ..... 62/530
2,730,151 1/1956 Smith ..... 62/457.1
4,343,158 8/1982 Campbell ..... 62/372
4,537,313 8/1985 Workman ..... 62/457.1 X
4,892,226 1/1990 Abtahi ..... 62/457.1 X
5,048,734 9/1991 Long ..... 224/148

*Primary Examiner*—Albert J. Makay
*Assistant Examiner*—William C. Doerrler
*Attorney, Agent, or Firm*—Roger A. Marrs

[57] ABSTRACT

A carrying bag or case is disclosed herein for storing heat sensitive cosmetics or the like in an internal storage compartment having a releasable fastener for closing an opening leading into the storage compartment. The storage compartment is surrounded by an auxiliary storage compartment for holding a replaceable refrigerant adjacent to the stored cosmetics which maintains the cosmetics or the like at a suitably low temperature to avoid spoiling. The carrying bag walls defining the storage compartment consists of a layered construction including flexible cushioning as well as temperature controlling characteristics.

4 Claims, 1 Drawing Sheet

PORTABLE REFRIGERATED COSMETIC CARRYING BAG

BACKGROUND OF THE INVENTION

1. Field of the Invention

The present invention relates to the field of carrying bags or cases for heat-sensitive cosmetics, and more particularly to a novel portable bag or case having an internal compartment for holding a quantity of cosmetics, which is surrounded by an auxiliary compartment for holding a suitable refrigerant, and which further includes a wall structure which is conducive with maintaining the storage and auxiliary compartments in a cool condition.

2. Brief Description of the Prior Art

In the past, it has been the conventional practice to employ cosmetic products, such as lipsticks, facial foundations and other lotions and creams that are formulated with a base material commonly composed of a wax-like or cream-like substance. Such products and substances are relatively sensitive to heat, and accordingly, are subjected to melting, cracking and other degradation when exposed to heat, even for relatively short periods of time. Since women typically carry a supply of many such cosmetic products with them at all times, this characteristic of potential damage to products is particularly prevalent in warm weather climates.

Although some attempts have been made to provide portable apparatus for refrigerated storage and transportation of cosmetics, such as disclosed in U.S. Pat. No. 4,892,226, problems and difficulties have been encountered which stem largely from the fact that the refrigerant used to maintain the cosmetics cool suffers from a relatively short and temporary life span since the refrigerant has a tendency to melt, which obviates its use. This problem stems largely from the fact that the wall structure defining the various storage compartments in the carrying bag itself does not properly insulate the refrigerant from outside environmental factors.

Therefore, a long-standing need has existed to provide a novel portable carrying bag for heat sensitive products of all kinds which not only conveniently stores a quantity of refrigerant but includes a wall structure which assists in maintaining the compartments in a cool condition and which will reflect heat radiation rather than absorb it as is the practice with conventional refrigerant storage bags.

SUMMARY OF THE INVENTION

Accordingly, the above problems and difficulties are obviated by the present invention which provides a novel portable carrying bag or case for heat-sensitive products, which includes a layered wall structure which is folded over upon itself so as to define an opening leading into an internal storage compartment into which the heat. sensitive products are held. The storage compartment is surrounded by an auxiliary compartment into which refrigerant packs are insertably received on opposite sides of the storage compartment so that the products held therein are maintained at a low temperature level. The layered structure includes an outer layer of heat and light reflective material and includes a temperature insulating material, such as neoprene, as well as a micro-fiber insulation layer. A special plastic coated reinforced metal layer resides adjacent to the refrigerant and an inside lining separates the refrigerant storage compartment from the internal heat-sensitive product storage compartment.

Therefore, it is among the primary objects of the present invention to provide a novel carrying bag or case which includes not only an auxiliary refrigerant carrying compartment adjacent to a cosmetic storage compartment but includes a layered wall construction defining the sides of the bag having improved heat insulating characteristics.

Another object of the present invention is to provide a novel cosmetic bag having an auxiliary compartment for holding freezer packs of refrigerant within a folded-over layered construction of novel and heat insulative characteristics.

Still another object of the present invention is to provide a novel layered wall structure for defining a storage compartment in a carrying bag for cosmetics which includes waterproof, Nylon material as well as solar reflective outer material so that the inner temperature of the bag can be maintained at a cool or low temperature level for at least eight to twelve hours.

Another object of the present invention is to provide a novel layered construction for defining a portable carrying bag for cosmetics or the like wherein the construction includes a solar reflective outer fabric adjacent to a layer of neoprene which is followed by a layer of micro-fiber insulation and with a double layer of reinforced Mylar defining a refrigerant storage compartment between its opposite surfaces.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
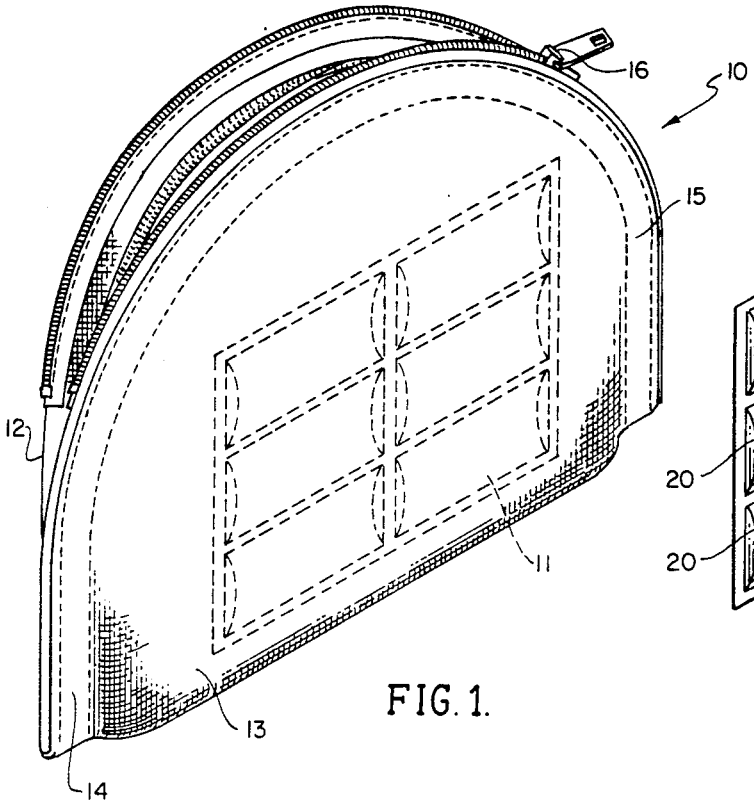
FIG. 1 is a front perspective view showing a cosmetic carrying bag or case incorporating the present invention.

Referring to FIG. 1, the novel carrying case of the present invention is indicated in the general direction of arrow 10 which includes a pair of inner compartments for storing the heat-sensitive cosmetic products and for storing the refrigerant. The refrigerant is indicated in the form of a pack in broken lines by numeral 11 and the carrying case includes a wall structure folded over upon itself to define sidewalls 12 and 13 respectively. The edge marginal regions of the sidewalls 12 and 13 are partially joined together, as indicated by numerals 14 and 15. This construction provides for a central opening across the top of the carrying case leading into the pair of compartments. A closure means, such as a conventional zipper 16, is provided across the adjacent edge marginal regions of the sidewalls so that the user may readily close the carrying case when desired.

Figure 2:
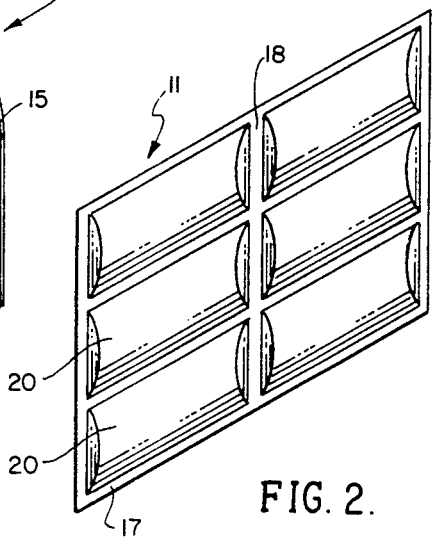
FIG. 2 is a front perspective view of a refrigerant pack used with the storage bag shown in FIG. 1.

Referring now in detail to FIG. 2, the refrigerant pack 11 is illustrated and is fabricated of at least two elongated rectangular sheets of plastic material that is selectively heat-sealed together in facing parallel relationship not only along their respective perimeter edges, such as at edge 17, but sealed as illustrated by numeral 18 at selected locations between the edge marginal regions of the sheets. In this manner, several liquid-tight compartments, such as indicated by numeral 20, are defined within each of which a quantity of a freezable liquid is contained. Any suitable freezable liquid may be utilized, such as water or any of several conventional freezable gel-like substances. The seal lines in the plastic material of the refrigerant pack enable it to be folded into a rectangular or other geometric configuration conforming to the sidewalls of the carrying case while also providing the refrigerant pack with a sufficient degree of collapsibility from such rectangular disposition to conform to the configuration of the case 11. In actual use, the refrigerant pack 11 is initially placed in a sub-freezing environment, such as a freezer area of a refrigerator, in order to freeze the liquid material contained in each of the respective compartments.

Figure 3:
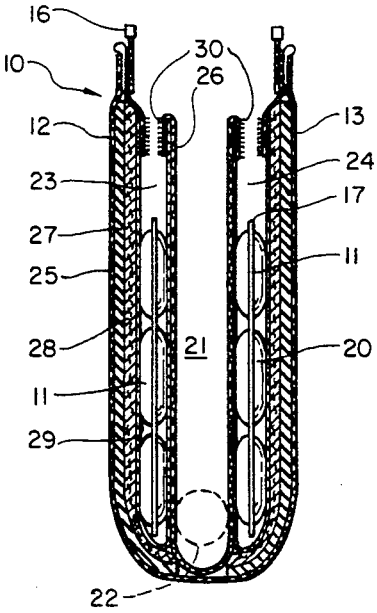
FIG. 3 is a transverse cross-sectional view of the cosmetic bag shown in FIG. 1 illustrating the cosmetic storage compartment surrounded by the auxiliary refrigerant compartment.

Referring now in detail to FIG. 3, it can be seen that the interior of the carrying case 10 includes an internal cosmetic product storage compartment 21 into which a heat-sensitive product such as lipstick is held, and the product is indicated by numeral 22. An auxiliary compartment is indicated by numeral 23 on one side of the storage compartment 21 and another auxiliary compartment 24 is illustrated on the other side of the storage compartment 21. Each of the respective auxiliary compartments is employed for insertably receiving a refrigerant pack 11 so that the heat-sensitive products within the storage compartment 21 are substantially surrounded in a cool and low temperature environment.

The wall structure comprising the sidewalls 12 and 13 consists of a layered construction having an outside fabric layer 25 which extends from the top of one sidewall around the under side and up to the top of the opposite sidewall. An identical inside fabric layer is indicated by numeral 26 which forms both sides of the storage compartment 21 and defines the compartment between the opposing surfaces thereof. Preferably, the outer and inner fabric layers 25 and 26 are composed of a solar reflective material so that radiant heat waves will be reflected from the surface and will not substantially penetrate the layered wall. A neoprene layer is indicated by numeral 27, which has a smooth Nylon surface facing inwardly against a micro-fiber insulation, indicated by numeral 28. The next layer of the walled structure is a reinforced Mylar layer 29 which extends from the zipper closure 16 so as to be folded over upon itself and terminating in a Velcro closure, as indicated by numeral 30. The space provided between the opposing surfaces of the folded-over mylar layer 29 defines the auxiliary compartment 23 on one side and in similar construction, the auxiliary compartment 24 on the opposite side of the carrying case. The respective refrigerant packs may be inserted into each of the respective auxiliary pockets through the upper opening which may be closed by the hook and pile closure 30. The hook component is carried on one side while the pile component of the fastener is carried on the other side in opposing relationship. When pressed together, the closure seals the refrigerant pack in each of the respective auxiliary compartments. The respective layers of the wall structure may be of a continuous fabrication and then folded over to form a hinge at the bottom of the carrying case or, as illustrated in FIG. 3, selected layers may be provided with openings or a central opening to define a suitable hinge. Layers 25 and 26 are shown in continuous arrangement as is the Mylar layer 29.

Figure 4:
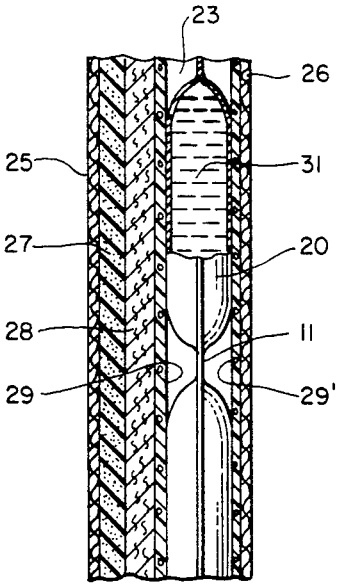
FIG. 4 is an enlarged sectional view of the layered wall construction defining the auxiliary refrigerant storage compartment employed in the carrying bag shown in FIGS. 1 and 3.

Referring now in detail to FIG. 4, an enlargement of the wall structure is illustrated in which the auxiliary compartment 23 is defined by the opposing wall surfaces of the layer 29 on one side and its opposite surface 29'. The refrigerant pack compartment 20 encapsulates a suitable refrigerant substance, as indicated by numeral 31, and it can be seen that the Mylar layer 29 is reinforced by micro-ribs extending across the entire area of the layer. The micro-fiber insulation may be purchased under the trade name Thinsolate and the neoprene layer 27 is identical to material employed in the fabrication of wet suits. This material has a smooth Nylon coating facings on one side of the layer facing inward which resides against the opposing surface of the micro-fiber insulation layer.

In view of the foregoing, it can be seen that the carrying case of the present invention provides a central storage compartment 21 into which heat-sensitive articles or products can be stored and that the central storage compartment 21 is, in effect, surrounded by auxiliary compartments 23 and 24 into which the refrigerant packs are held. The hook and pile closures 30 at the top of each of the auxiliary compartments maintain the packs in position, provide sealed compartments and the packs are flexible so as to be in shape with the sidewall structure of the carrying case. The central compartment is maintained in a cool or low temperature condition over a long period of time by means of the layered wall construction employed in creating the carrying case. The separate and individual physical characteristics of each of the layers in the wall structure are employed for ensuring that the low temperature condition is maintained over a long period of time as provided by the refrigerant packs.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A carrying bag for heat-sensitive products comprising:

a pouch-type bag having a main opening leading into the interior of said bag;

a first and second storage compartment within said bag interior and separated by a heat-sensitive products compartment;

thermal insulation of non-absorbent material disposed between said first and second storage compartments and said heat-sensitive products compartment respectively;

refrigerant packs insertably disposed in each of said first and second storage compartments;

said thermal insulation is a multiple layered construction including a metallic layer arranged on opposite sides of each of said refrigerant packs, a micro-fiber insulative layer outside each metallic layer, a neoprene layer adjacent said insulative layer and an outer fabric layer of solar reflective material;

an inner layer of fabric adjacent each of said metallic layers defining said heat-sensitive products compartment between opposing surfaces thereof; and said neoprene layer having opposite surfaces with a selected surface coating with Nylon material facing inward towards said heat-sensitive products compartment.

2. A chilled cosmetic carrying device for storing heat-sensitive products in a high temperature ambient environment for a prolonged period of time comprising:

a carrying bag having flexible sidewalls with opposing surfaces defining a central storage compartment therebetween;

said carrying bag further having a pair of auxiliary compartments separated by said central storage compartment;

a refrigerant pack insertably disposed in each of said auxiliary compartments;

closure means disposed on said auxiliary compartments selectively closeable to retain each of said refrigerant packs in said respective auxiliary compartments;

a main closure means disposed on said sidewalls to releasably close said central storage compartment;

said sidewalls are composed of a wall structure having multiple layers of thermal insulative materials;

said wall structure includes an outer fabric layer of solar reflective material, an interior layer metallic material of high strength-to-weight ratio and inner layers of neoprene and micro-fiber materials separating said interior and outer layers;

said metallic layer is non-absorbent and resides adjacent to said refrigerant pack; and said neoprene inner layer having a Nylon covered surface facing inward towards said central storage compartment.

3. The invention as defined in claim 1 including:

said bag having a fold-line along its bottom constituting a fold-over hinge for opening and closing said main opening.

4. The invention as defined in claim 3 wherein:

said fold-over hinge is provided by said outer fabric and said metallic layers along the bottom of said bag;

said other mentioned layers terminating along said fold-over hinge.

* * * * *